United States Patent [19]

Boenisch

[11] 3,958,795

[45] May 25, 1976

[54] APPARATUS FOR MIXING MATERIALS

[76] Inventor: Dietmar Boenisch, 45, Morillenhang, Aachen, Germany

[22] Filed: Mar. 11, 1975

[21] Appl. No.: 557,347

Related U.S. Application Data

[62] Division of Ser. No. 274,762, July 24, 1972, Pat. No. 3,871,623.

[30] Foreign Application Priority Data

July 26, 1971 Germany ..... 2137277

[52] U.S. Cl. ..... 259/2; 222/161; 222/203; 222/394; 259/29; 259/54; 259/72; 259/180

[51] Int. Cl.[2] ..... B22C 5/02; B22C 5/12; B01F 15/02; B01F 5/26

[58] Field of Search ..... 259/2, 12, 17, 29, 35, 259/54, 56, 72, 91, 147, 150, 151, 173, 180; 222/161, 203, 394

[56] References Cited

UNITED STATES PATENTS

| | | | |
|---|---|---|---|
| 930,084 | 8/1909 | Reed | 259/150 |
| 2,287,829 | 6/1942 | Bryan | 222/394 X |
| 2,792,262 | 5/1957 | Hathorn | 222/203 X |
| 3,572,653 | 3/1971 | Boenisch | 259/2 X |
| 3,814,386 | 6/1974 | Guglietti | 259/2 |

*Primary Examiner*—Robert W. Jenkins
*Assistant Examiner*—James A. Niegowski
*Attorney, Agent, or Firm*—P. D. Golrick

[57] ABSTRACT

Apparatus for mixing fluent materials, especially components for foundry molding compositions, affording a pluralities of containers feeding serially one to another or in parallel discharging to a common acceptor, for batch or continuous operations, permitting simultaneous mixing of all components, either all brought together at once or, as for reactive component mixing, in parallel diverse component group mixing flows, joined for final mixing bringing the reactive components together; and an agitated shooter injector vessel receiving the mixed material, pneumatically actuated to expel material into a mold or the like.

16 Claims, 6 Drawing Figures

FIG. 2
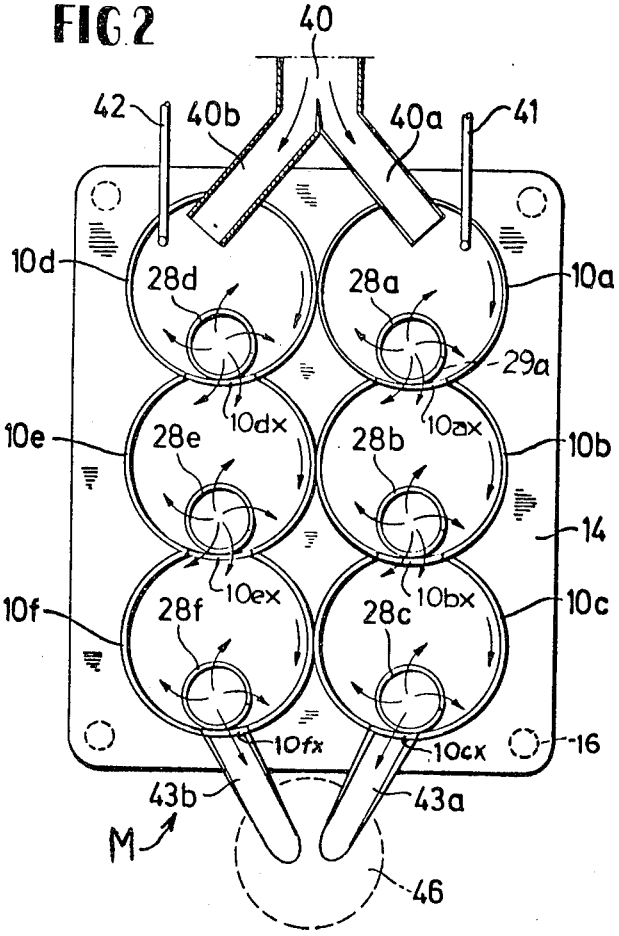
FIG. 3
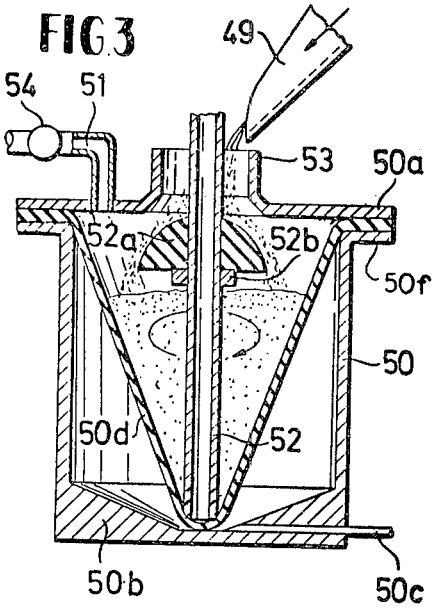
FIG. 4
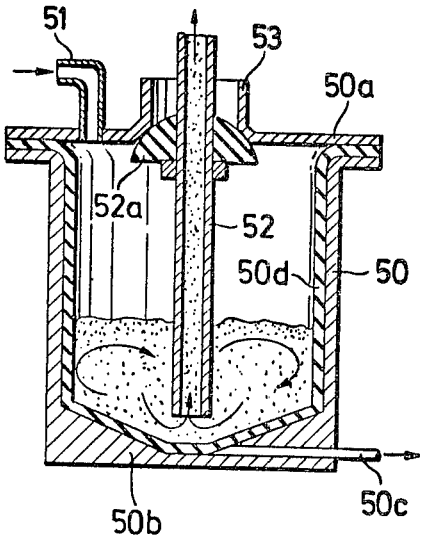
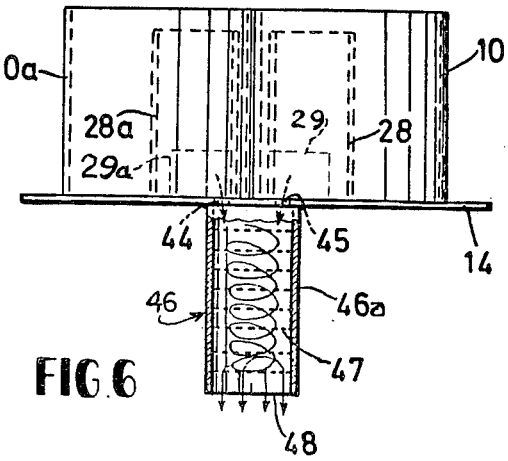
FIG. 6
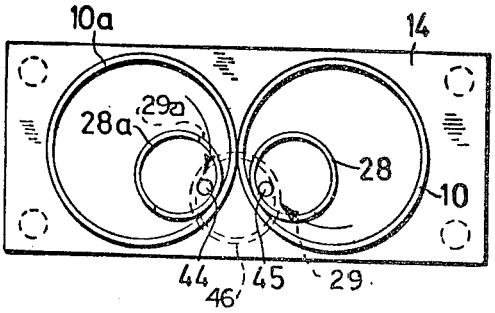
FIG. 5

APPARATUS FOR MIXING MATERIALS

This application is a division of co-pending application Ser. No. 274,262 filed July 24, 1972, now U.S. Pat. No. 3,871,623 granted Mar. 18, 1975.

The present invention is concerned with apparatus for mixing of materials, particularly the constitutents for foundry molding compositions by means of a mixing apparatus, subjected to oscillation involving motion in a circular sense about a substantially vertical axis, not what is usually called rotational oscillation, but what is here termed an orbital oscillation as hereinafter defined, to establish a circular movement of material to be mixed in at least two more or less vertical parallel regions, preferably in more less parallel or vortical streams, in which respectively there is a circular motion about the axis or line of advance of the stream, with exchange of the material between the said regions or streams in diverse manners.

By orbital vibration or oscillation, here is meant the movement of a body, wherein each point thereof tends to move about a closed curved path about its respective distinct axis, without any rotation of the body as a whole with all points thereof swinging coaxially about a common center or axis; the particular type of which motion will appear from the apparatus hereinafter disclosed.

There is a continually increasing demand in various industrial processing technologies for short mixing times for materials involved in the processes. This is true in foundry industries for the mixing of molding compositions, where, for example, quartz sands are bonded with a synthetic resin to which are added activators, catalysts or hardeners, the reaction of which, leading to a setting of the molding composition, should take place first in the molding flask rather then in the mixing apparatus.

To meet this need, especially with foundry molding compositions, by the present invention, it is proposed to use an orbitally oscillating or vibrating mixing container having therein certain partitions, material guides, baffles or the like to establish two or more comparatively distinct vertical regions of circular or rotating movement of the material to be mixed, preferably essentially vertical vortex type streams, between which there occurs a constant exchange of material, to generate further mixing action in addition to that occurring within each region or stream.

These regions or vortical streams can be disposed or directed adjacently to one another but also one region or stream may be located or move within another, in the simplest case when one is disposed and moving co-axially within a second.

Further in accordance with the invention, where the vertical regions or streams have a like rotational direction, especially when adjacent one another, there occurs particularly heavy exchange between the two streams or regions at what might be loosely called their "interface," that is area of contact.

Basically, an apparatus for mixing of materials in accordance with the invention comprises an orbitally oscillating vessel or main container within which are disposed vertically extended guide elements, e.g., tubular or baffle-like in form, which open toward and are adapted to receive a generated main flow or stream of material in the container, and so set up a circular motion in a distinct local vertical region or an upwardly moving stream of material.

Such guide elements or means, disposed within the mix charge receiving main vessel or container, here at times are referred to as mixing devices.

In one type of embodiment of the invention these mixing devices take the form of vertically extending elements, which in cross section may vary from a trough-like to a tubular shape; and thus, in a sense, locally at each of the devices, there is formed a shaft-like structure, that is, a vertical material passage, in practical sense a second mixing container internal of the main vessel.

In preferred mixing apparatus embodiments of the invention the mixing container is driven with an oscillation amplitude which is independent of the load and also of accelleration and decelleration, so that dangerous resonance motion and over-drive or whipping motions are avoided.

Further in a preferred embodiment, there is used a positive eccentric drive affording adjustability of oscillation, which is constant over the cycle of the mixing process, but also enables variation of the oscillation rate at will. By appropriate choice of the eccentric shape, and of its drive motor rotational rate, optimal mixing conditions can be obtained, indeed with comparatively small mixing vessels, nonetheless a large through-put rate. The drive rotational speed may be advantageously used of from 1,500 to 5,000 rpm, and can also run as high as 10,000 rpm; through 3,000 rpm is convenient. Thus for either batch or continuous operations, within a few seconds, very intensive through mixing can be obtained with small mixing apparatus.

It is the general object of the present invention to provide an improved apparatus for mixing of various fluent components, at least part of which are or may be made particulate or granular, whereby good mixing may be achieved in a comparatively brief time.

A further object of the invention is to provide apparatus for mixing fluent components of the character described, wherein the charge or body of materials to be mixed is subjected to orbital oscillation and, at least a portion of the charge is deflected from a circularly streaming motion of the main body of the charge to develop a rather distinct vertical region of another circular motion or a vertically directed vortical stream of the material, thus establishing at least two parallel gross movements of material in distinct paths between which the constant exchange of the material is occurring.

A still further object of the invention is to provide a basically simple orbitally oscillating apparatus for carrying out the mixing, either as a batch or continuous through-put operation.

A still further object is the provision of apparatus operating on the principles described, which enables simultaneous pre-mixing of distinct mix or charge portions containing different components, for example, components of a final total composition desired to be kept as long as possible from re-active contact, and finally bringing together the pre-mixed portions or streams for a final mixing and discharge to a point of use.

A still further object of the invention is the provision of apparatus in which the basic mixing functional operation is included in a projection type molding machine.

Other objects and advantages will appear from the following description and drawings wherein:

FIG. 2 is a top plan view of a mixing apparatus comprising two rows or sets of respectively serially connected mixing containers simultaneously mixing two portions of components and discharging through a common final mixing chamber;

FIG. 3 is a vertical axial sectional detail view of the molding composition projector appearing at the left in FIG. 1, shown in open condition for charging;

FIG. 4 is similar to FIG. 3, but showing the projector as in its discharge operation;

FIG. 5 is a top plan view of an apparatus with two adjacent simultaneously oscillated independent mixing containers;

FIG. 6 is a view generally in side elevation but partially in vertical section corresponding to FIG. 5.

In the following descriptions like numerals will be used for like parts, or parts of analogous function though appearing in somewhat different form.

GENERAL ORGANIZATION

Figure 1:
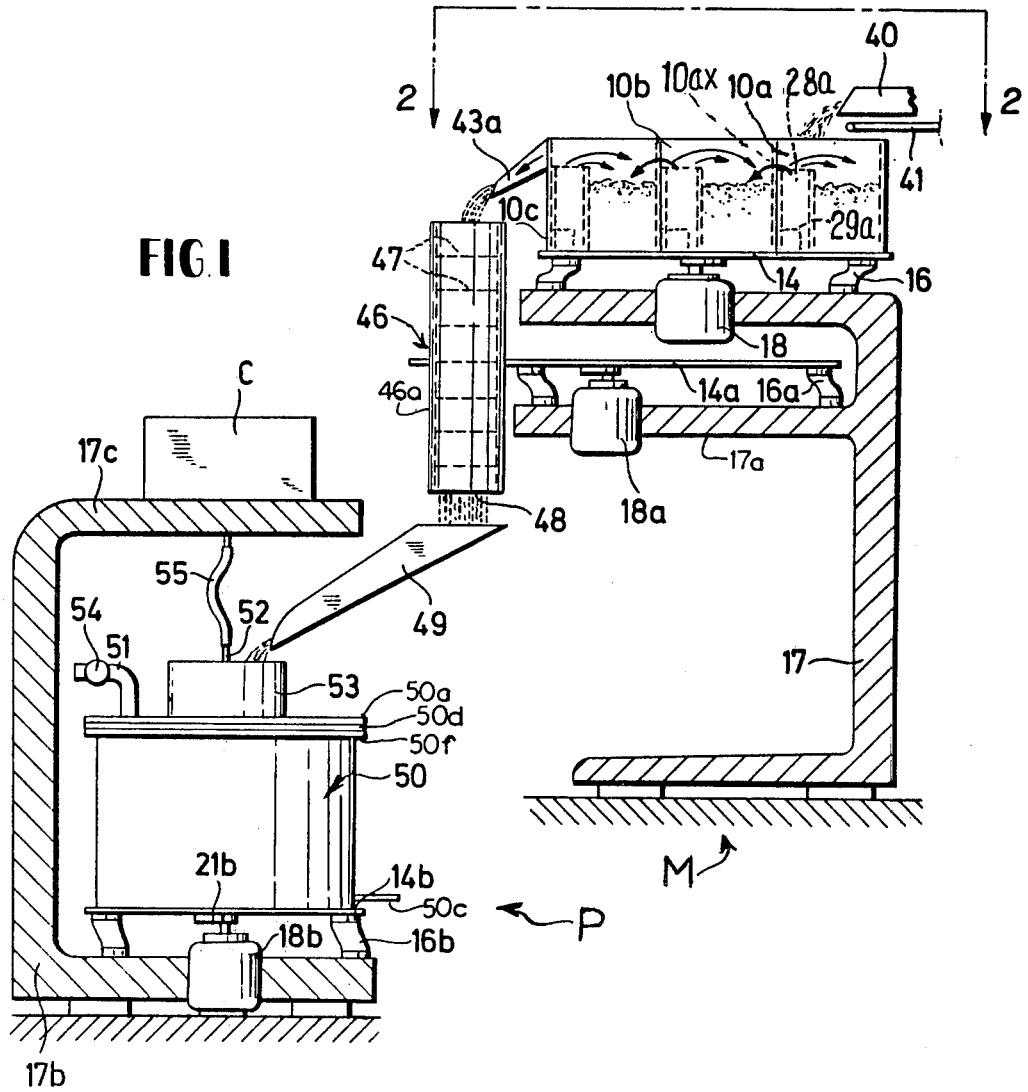
FIG. 1 shows, partially in section and partially in elevation, a foundry molding composition mixing and projection machine, such as a mold blowing or core shooter machine.

The general organization of the apparatus is shown in FIG. 1 as comprised broadly of a component mixing apparatus section M at the upper right; and at the lower left, a molding sand composition blowing or injection apparatus section P, which receives the finished molding composition from S and shoots it into successive mold flask parts or core boxes, each positioned at C.

The mixing section may for some requirements take the larger apparatus form shown in and described with respect to FIGS. 1 and 2, or the smaller capacity form of FIGS. 5–6. Both arrangements of the mixing apparatus are quite advantageously suited for carrying out of molding methods by the so-called cold resin process to prepare molds and cores for casting production in the foundry industry.

By that process sand, generally quartz sand, is mixed with a resin as a binder agent and certain hardeners, various acids, for setting the resin and thereby solidifying the foundry molding composition. The resin type and the proportion of the resin to acid can be so selected that the setting will occur in a very short time, even in a few seconds, so that by such procedures an economic and automatable molding process is feasible. However, for success with such methods, a pre-requisite is the use of mixers which both work extremely rapidly and have a very simple form of construction, with which the strong tendency of the reactive sand-resin-hardener mixture to set up and form incrustations form the mixer surfaces either can be avoided or at least presents no particular problem. on In this cold hardening process, large quantities of molding sand compositions are required, often many tons per hour, for which continuous mixers are particularly advantageous.

The mixing section apparatus shown in top plan view in FIG. 2 and appearing at the right of FIG. 1 in the larger combination, represents a mixer combination suitable for such uses. on a single rectangular base plate 14 supported and by an eccentric motor drive oscillated as described in the said copending application and patent especially relative to FIGS. 1, 7, 28 and 29 thereof, there are two parallel sets of three series-connected mixing vessels each with respective tubular mixing shaft elements, 10*a*–28*a*, 10*b*–28*b*, 10*c*–28*c* in one, 10*d*–38*d*, 10*e*–28*e*, 10*f*–28*f* in the other. To each of these series sets sand is fed at a predetermined rate from a vibratory conveyor 40 or other suitable conveying mechanism, divided into the two streams at 40*a* and 40*b* feeding into the respective first containers 10*a* or 10*b* of the series, along with simultaneous measured delivery of the resin and of the hardener through supply pipes 41 and 42, so that in one series resin is being pre-mixed with sand, in the other hardener with sand, in two parallel streams finally leaving through the discharge outlet troughs 43*a*, 43*b*, for mixing of the final total composition in a rapid mixer 46 therebelow.

The form of the individual vessels and their respective tubular mixing shaft devices or elements is basically similar in structure and mode of individual operation. From the main mass of material, which is flowing in an assumed clockwise direction as indicated by the arrows along the vessel walls in FIG. 2, at the bottom of the vessel, (e.g., considering vessel 10*a*; the vessel and the associated parts having corresponding suffixed letters in FIG. 2), a portion continually enters an inlet opening 29*a* in the bottom of the tube 28*a* on the side facing the direction from which the mass approaches along the vessel wall. Thus in the shaft tube there is produced separately moving smaller upwardly spiralling or vortical flow, which leaves the top of the tube in a circumferentially fanning or scattering discharge. Material returning from the shaft tube to the respective vessel is thus distributed over the top of the main mass for mixing recirculation in what is actually a clockwise downward spiral or vortex flow. As the containers "intersect" one another at a region providing a discharge window or opening 10*ax* to 10*fx* through which a part of the scattering discharge from the top of the respective tubular shaft discharges; from each container to its successor in each series or to the discharge trough 43*a* or 43*b*, but here the respective tubes are disposed roughly at 180° from the point of in-feed to each container.

There is a thorough mixing of the resin component with sand and of the hardener component with sand, in flows simultaneously passing through the respective series of mixing vessels; these mixings or sub-mixings, during this important pre-mixing phase of the overall mixing, keeping resin and hardener totally separate so that they can not begin to react until the two mixing flows are brought together in discharging from 43*a* and 43*b*, into the rapid mixing chamber 46 also described relative to and shown in FIGS. 5–6.

FIG. 1 shows the larger combination of apparatus for the mixing and preparation of the molding composition on through to its use in discharging to a mold flask or a core box. At the upper right, the heavy pedestal 17, of cast iron or other suitable material, shown in section, at its top surface through the resilient or elastic support elements 16, supports the mixing section apparatus described with respect to FIG. 2, and a drive motor 18 for an eccentric drive of the base plate 14.

Here the rapid mixing chamber 46 is mounted on a separate oscillating plate or base table 14*a*, in turn supported through the elastic support elements 16*a* on a lower shelf portion 17*a* and eccentrically driven by a separate drive motor 18*a*. The chamber 46 rapidly thoroughly mixes the two streams of separately premixed materials delivered by 43*a*, 43*b* to discharge the final completely mixed molding composition at 48, into inclined trough 49 feeding either directly into a mold flask or core box, where the reactive mixture sets up after a few seconds to provide a finished core or mold, or to discharge into the apparatus section P at the lower left side of FIG. 1 which may be broadly described as a mold blowing or core shooter apparatus.

The motors 18 and 18*a* provide separate drives for independent operation of the respectively actuated apparatus devices. Considering operation of the mixing section alone, turning off the motor 18 immediately interrupts the discharge streams from 43*a* and 43*b*; at which time also, of course, the supply of sand at 40 and to the resin and hardener at the supply tubes 41 and 42 is to be cut off, so that advantageously the power for the component feeding system is normally simultaneously cut off along with power to the motor 18, as by one main switch or other known controls.

The rapid mixing chamber 46 can be allowed to run on continously or if desired only for a brief time for the thorough mixing of the desired molding composition amount.

Thus, by control of the duration of mixer operation, it is possible to withdraw precisely the molding composition desired to be dispensed, and in amount exactly suited to the molding sand composition requirement for making of respective molds or cores as may be required, so that the apparatus is quite flexible in uses, and quite suited for making successive molds and also cores of quite diverse weight.

Application of the present mixing invention in the continuous mixer described with respect to FIGS. 1 and 2 has a further very important advantage that no part of the entire machine can be afflicted by incrustations, because the necessary chemical reaction has no opportunity to occur during the swift transit of the mix.

Incrustations in the rapid finish mix chamber 46 to some extent are indeed unavoidable, but through constructional expedients they present little trouble. The basic tube 46*a* can be built up from heavy paper board, synthetic plastic or other suitable low cost stock in individual tubular sections between which are clamped and mounted perforated rubber sheets as the sieves 47; a structure therefore also to be taken apart and cleaned. But also in consequence of the possible simple construction from cheap materials this chamber can be a throw-away component intended to be replaced by a new part after incrustations have set in.

This last described mixer combination for carrying out of the cold hardening mold manufacturing method can advantageously be supplemented by an air pressure operated mold blowing or core shooting type mix projecting machine for the making of molds or cores, with the latter machine likewise operated on the oscillation principal. In this way even the compaction of the reactive molding composition in the mold or core box can be essentially accelerated and the preparation time accordingly shortened.

Details of a basic oscillating vessel 50 are presented in sections FIGS. 3 and 4, showing conditions for charging and discharging stages of operation. A lower portion of a sturdy rigid pedestal 17*b* mounts a fixed drive motor 18*b*, again through an eccentric connection 21*b* orbitally oscillating the table 41*b*, supported on the pedestal through the resilient elements 16*b*, and carrying vessel 50. The drive of the oscillating table for the mold blowing mixture container 50 and the oscillating finish mixer 46 and the larger multiple vessel mixer can be similar in their operating frequencies and amplitudes. The top shelf 17c supports the mold flask, core box or the like receptacle C to be filled or charged from vessel 50 with a molding sand composition.

The vessel 50 comprises a heavy cylinder secured on the oscillating plate 14*b*, through the shallowly conical bottom 50*b* of which there extends an air vent or vacuum application pipe 50*c*; an internal elastomeric rubber diaphragm sheet or lining 50*d*; a top closure or cover 50*a* circumferentially clamping the lining top margin against the vessel top flange 50*f* in an air sealing relation by bolts or other suitable means not shown and having a central upwardly circumferentially flanged vessel inlet or charging opening 53.

A hollow discharge pipe or injection tube 52, co-axially shiftably mounted and extending upwardly through the cover opening 53, carries an upwardly convex hemispherical rubber-like resilient sealing stopper or plug element 52*a* supported from below by the collar 52*b* which is sealingly seatable against the inside periphery of the cover opening. The discharge or shooting tube 52 is connected in turn by flexible tubular element 55 with an inlet or nozzle supported in the pedestal top level platform 17c for ultimately directing discharged molding composition into the core box or mold flask C or other receiving vessel as shown. An air inlet pipe 51 through the cover provided with a valve 54, either manual or automatically operated, admits and releases air to an upper chamber defined between the cover 50*a* and the diaphragm sheet 50*d*.

The diaphragm or sheeting 50*d*, held tensioned between the lid and the top flange of the container in airtight relation, in the condition of FIG. 3 is tensioned against and closing the lower or inlet end of the tube 52 when the latter is moved downwardly by appropriate shifting means (not shown in the drawings), thereby opening a circumferential gap between the inlet opening 53 and the stopper 52*a*. On the other hand the elastic tension of the diaphragm normally urges the tube 52 and the stopper element firmly into seated relation, when the latter is raised, to provide an air tight closing of the charging opening.

The now reactable molding sand mixture is supplied from the rapid mixing chamber 46 through the discharge trough 49 into the vessel inlet 53, in open condition as shown in FIG. 30, in an amount suited for the mold or the core to be produced. As soon as the requisite amount is charged, and the container closed by raising the plug 52 to seated position, air valve 54 is opened, admitting air from the pressurized supply source into the vessel 50 as in FIG. 4 shown, causing downward extension of the diaphragm 50*d* into conformity with the inner wall surfaces of the vessel, air being vented from below the diaphragm through 50*c*, or the diaphragm even drawn down by simultaneously applied vacuum, thus carrying the diaphragm away from the discharge tube, through which the charge is suddenly shot upwardly out of tube 52 through 55 into the receptor 56 with compaction assured.

The orbital oscillation of the container 50 during charging and up to the time of complete discharge serves first to continue a mixing action, also to keep the charge loose and porous, and further assures its ready flow down to and into the lower inlet end of discharge tube 52 for a free and ready complete discharge under air pressure into the receptor.

To initiate the charging process the air valve 54 is closed, the upper space vented, for example by dropping the tube 52 or by a three-way valve at 54, and a new charge fed in. All such operatios are as aforementioned advantageously carried out with continued oscillation of the machine.

This mixing and sand shooting or mold blowing apparatus as described has the following important advantages:

1. The combination comprised of a continuous mixer and rapid finish mixing chamber, as shown in FIG. 2 and at the right of FIG. 1, can simultaneously service several oscillating mixing type mold blower or core shooting apparatuses; and thereby machine idle time which is determined by the time required for the molding composition to set up in flasks or core boxes can quite extensively be avoided.

2. The mixer combination operates without dependence on valves or closures so placed that they can become blocked by setting of molding composition.

3. Incrustation in the oscillating mixer type mold blower machine is avoided, because the reactive molding composition comes in contact for any notable time with only the rubber diaphragm; and because the latter, continually changing shape and tension in shifting between charging and discharging positions, is continually repeatedly strongly stretched and contracted, so that deposits or crusts even at an incipent condition are immediately cast off.

4. Furthermore the constant intense shaking motion of the mixing projecting machine itself provides three important advantages:

a. During the charging time, the already reacting molding composition is kept loose and porous and incipent adhesion is avoided.

b. The charge blowing or shooting process, the transfer in the discharge conduit, and the emptying of the vessel are extraordinarily facilitated, in consequence of the marked mobility of the agitated charge and its rotationl motion. While conventional sand projector machines, such as core shooting or mold blowing machines, generally work with a projection pressure of from 5 to 6 atmosphere gauge, the apparatus of the present invention, even at about two atmosphere gauge pressure provides cores and molds with a quite sufficient density and compression. Accordingly it is possible to use relatively cheap and simple air seals; and also the pressurized air consumption is low.

c. Any molding composition left in the machine after the charge projection, in consequence of the shaking motion remains fluent and granular and is taken up by the subsequent fresh charge without detriment.

In FIGS. 5 and 6 two independent mixing vessels 10 and 10*a*, each having respective tubular mixing shaft elements 28 and generally the form and disposition represented in FIG. 7 of, and described in, the aforementioned application and patent, are mounted adjacently on a base or oscillating table 14 as a common bottom wall but without a direct inter-connection between their cylindrical spaces.

Controllable respective discharge apertures 44 and 45 open from the respective tube structures 28*a* and 28 through the bottom wall into the top region of a rapid finish mixing chamber 46 secured to the bottom of plate 14 to oscillate therewith. Apertures 44–45 are provided with appropriate stoppers or shutter means (not shown). Chamber 46 is comprised of the vertical cylinder or tube 46*a*, sub-divided above its discharge end 48 into smaller vertically successive mixing chambers by apertured horizontal inserts 47, in the form of perforated or slotted plates or rigid sieve screens.

Accordingly in each of the respective mix vessels 10, 10*a*, mixing of diverse and separate charges of components simultaneously may proceed to a thorough mixing; and, as soon as these preliminary mixings are completed, the respective charges are released to the top of chamber 46, and with the continuing oscillation of the apparatus, the pre-mixed batches flow in steady streams onto the first partition 47, thence descending through and finally mixed in the successive chambers during the dwell time which it takes to advance to discharge at the bottom end 48.

Thus for example, in this arrangement of FIGS. 5–6, sand and a binder resin can be mixed in one vessel 10, sand and resin hardener or activator in the other 10*a*, so that the respective sub-mixtures of the total batch can be retained in the two vessels unaltered as far as the reaction is concerned for a very long time.

The final mix reaching the bottom opening 48 is ready for discharge or acceptance directly into a mold flask or core box or other suitable receptor for further use. By appropriate timing of the duration of the opening of the respective controlled outlets 44 and 45, quite accurately dispensed amounts of the pre-mixed materials can be taken from respective container vessels 10 and 10a and mixed in chamber 46, to provide a final mix of such quantity as might be required for immediate use. This apparatus of FIGS. 5 and 6 is suited to mixing equipment feeding into mold and core making machines.

This arrangement of FIGS. 5–6 may be on a correspondingly simplified pedestal in place of the mixing section apparatus shown and described for FIG. 1.

What is claimed is:

1. A mixing apparatus for mixing fluent materials, particularly foundry molding materials, comprising:

a horizontal base and a plurality of at least two mix vessels secured on the base;

each mix vessel having a vertical circumferentially enclosing side wall and containing respective mixing means;

said base being resiliently mounted by means permitting orbital oscillation to the base, and therewith to each vessel oscillation about a respective vertical axis located within the confines of the vessel;

driving means imparting to said base and thereby to each said vessel said orbital oscillation in a horizontal direction thereby imparting a principally horizontally circular main flow to material contained in the vessel;

each said mixing means comprising at least one vertical tube-like element rigidly connected to and extending longitudinally within said vessel in a vertical direction away from the vessel bottom, and having in its bottom end region an inlet aperture opening to its interior tubular space above the vessel bottom and facing toward the direction from which said main flow approaches, whereby said element intercepts through said aperture a portion of the main flow to develop at least over the height of the element a separate spirally ascending flow discharging from the top of said element with circumferential scattering to be distributed at least in part over the surface of material in the vessel for mixing recirculation therewith; and a rapid finish mixing chamber disposed to receive material discharging from each of said two vessels and agitated to effect a quick final mixing and discharge of a finished molding composition.

2. A mixing apparatus as described in claim 1, wherein said two mix vessels being jointly connected, through suitably valved discharge openings, to said rapid finish mixing chamber;

said chamber being agitated by an oscillating drive.

3. A mixing apparatus as described in claim 2, wherein said rapid finish mixing chamber comprises:

a vertically extending tubular body open at the top end to receive material discharging from said two vessels and having a bottom outlet for a finished composition, and transverse separating walls of sieves or perforated plates sub-dividing the body into several mixing sub-chambers arranged one above the other in series.

4. A mixing apparatus as described in claim 2, wherein said discharge openings are disposed in the bottoms of respective mix vessels and open downwardly into said rapid finish mixing chamber, said chamber being disposed beneath the base for said mix vessels and connected thereto for oscillation therewith.

5. A mixing apparatus as described in claim 3, wherein said discharge openings are disposed in the bottoms of respective mix vessels and open downwardly into said rapid finish mixing chamber, said chamber being disposed beneath the base for said mix vessels, and said chamber is provided with independent agitating oscillatory drive means.

6. A mixing apparatus as described in claim 1, wherein said plurality is comprised of at least two pairs of mix vessels arranged on said base in two rows of series-connected vessels, each series row being provided with at least two component feed paths to a first vessel of, and a discharge path from a last vessel of, the row, the discharge paths of the two rows feeding into said rapid finish mixing chamber, and said chamber being provided with an oscillatory drive independent of the drive for said base.

7. In combination with a mixing apparatus as described in claim 1, an injection apparatus for injecting molding material into foundry mold flasks or core boxes comprising:

an injection cylinder vessel resiliently mounted with its axis vertical and driven by means imparting to the cylinder an orbital motion of translation with its axis describing a closed path on an intersecting horizontal plane, thereby to develop an agitated flow of material in the vessel, said injection vessel having a hollow cylindrical body closed at top and bottom ends, a charging opening in its upper end through which molding materials are charged into the vessel, and an inlet for air under pressure in its upper part;

an injection tube arranged in an upright position and extending within the vessel body from near the lower end thereof outwardly through the upper end thereof;

a flexible elastic diaphragm below the air inlet and the charging opening, extending completely across the interior of the injector vessel body and below the lower end of the injection tube, providing the effective material-containing interior surface of the body;

said diaphragm being arranged to have sealing engagement with the lower end of the injection tube and spacing from the bottom end and cylindrical interior of the body when the region above the diaphragm is unpressurized;

an air outlet from the body space below the diaphragm; and means for directing finished molding composition, discharging from the rapid finish mixing chamber, into said charging opening.

8. The apparatus combination as described in claim 7, wherein the diaphragm comprises a rubber sheet with peripheral edge clamped between the upper end of the injection vessel body and a top closure therefor; and said tube is disposed coaxially in said body.

9. The apparatus combination as described in claim 8, wherein the charging opening is centrally located in said top closure; and the injection tube is mounted for movement up and down through the charging opening and carries a sealing member to seal the opening when the injection tube is moved upwardly.

10. The apparatus combination as described in claim 9, wherein the bottom end interior has an inverted conical shape, and said air outlet communicates with the conical region of the bottom end.

11. The apparatus combination as described in claim 7, wherein said injection apparatus includes:

a platform spaced above said injection cylinder vessel to afford charging access to the charging opening;

said platform serving to support a mold flask, core box or a like container into which a molding composition is to be injected; and means including a flexible conduit connected to the upper end of the injection tube for directing material projected from said injection cylinder into a said container supported on the platform.

12. An injection apparatus for injecting molding material into foundry mold flasks or core boxes comprising:

an injection cylinder vessel resiliently mounted with its axis vertical and driven by means imparting to the cylinder an orbital motion of translation with its axis describing a closed path on an intersecting horizontal plane, thereby to develop an agitated flow of material in the vessel, said vessel having a hollow cylindrical body closed at top and bottom ends, a charging opening in its upper end through which molding materials are charged into the vessel, and an inlet for air under pressure in its upper part;

an injection tube arranged in an upright position and extending within the vessel body from near the lower end thereof outwardly through the upper end thereof;

a flexible elastic diaphragm below the air inlet and the charging opening, extending completely across the interior of the vessel body and below the lower end of the injection tube, providing the effective material containing interior surface of the body;

said diaphragm being arranged to have sealing engagement with the lower end of the injection tube and spacing from the bottom end and cylindrical interior of the body when the region above the diaphragm is unpressurized; and an air outlet from the body space below the diaphragm.

13. The apparatus as described in claim 12, wherein the diaphragm comprises a rubber sheet with peripheral edge clamped between the upper end of the vessel body and a top closure therefor; and said tube is disposed coaxially in said body.

14. The apparatus as described in claim 13, wherein the charging opening is centrally located in said top closure;

and the injection tube is mounted for movement up and down through the charging opening and carries a sealing member to seal the opening when the injection tube is moved upwardly.

15. The apparatus as described in claim 14, wherein the bottom end interior has an inverted conical shape, and said air outlet communicates with the conical region of the bottom end.

16. The apparatus as described in claim 12, wherein said injection apparatus includes:

a platform spaced above said injection cylinder vessel to afford charging access to the charging opening;

said platform serving to support a mold flask, core box or a like container into which a molding composition is to be injected; and means including a flexible conduit connected to the upper end of the injection tube for directing material projected from said injection cylinder into a said container supported on the platform.

* * * * *